US011098452B2

(12) United States Patent
Backfolk et al.

(10) Patent No.: US 11,098,452 B2
(45) Date of Patent: Aug. 24, 2021

(54) METHOD FOR MANUFACTURING A PACKAGING MATERIAL AND A PACKAGING MATERIAL MADE BY THE METHOD

(71) Applicant: Stora Enso OYJ, Helsinki (FI)

(72) Inventors: Kaj Backfolk, Lappeenranta (FI); Chris Bonnerup, Floda (SE)

(73) Assignee: Stora Enso OYJ, Helsinki (FI)

( * ) Notice: Subject to any disclaimer, the term of this patent is extended or adjusted under 35 U.S.C. 154(b) by 0 days.

(21) Appl. No.: 16/471,990

(22) PCT Filed: Dec. 18, 2017

(86) PCT No.: PCT/IB2017/058047
§ 371 (c)(1),
(2) Date: Jun. 20, 2019

(87) PCT Pub. No.: WO2018/116118
PCT Pub. Date: Jun. 28, 2018

(65) Prior Publication Data

US 2019/0352854 A1 Nov. 21, 2019

(30) Foreign Application Priority Data

Dec. 22, 2016 (SE) ..... 1651732-8

(51) Int. Cl.

| | |
|---|---|
| ***D21H 27/10*** | (2006.01) |
| ***B65D 65/42*** | (2006.01) |
| ***D21H 19/22*** | (2006.01) |
| ***D21H 19/60*** | (2006.01) |
| ***D21H 19/82*** | (2006.01) |

(52) U.S. Cl.
CPC ..... *D21H 27/10* (2013.01); *B65D 65/42* (2013.01); *D21H 19/22* (2013.01); *D21H 19/60* (2013.01); *D21H 19/822* (2013.01); *D21H 19/828* (2013.01)

(58) Field of Classification Search
CPC ..... D21H 27/10; D21H 19/82; D21H 19/84; D21H 19/822; D21H 19/828; D21H 19/00; D21H 19/48; D21H 19/58; D21H 19/36; D21H 19/80; B65D 65/42; B32B 2255/26
See application file for complete search history.

(56) References Cited

U.S. PATENT DOCUMENTS

| | | | | |
|---|---|---|---|---|
| 6,645,584 | B1 * | 11/2003 | Kuusipalo | B32B 27/10 428/34.2 |
| 7,364,774 | B2 * | 4/2008 | Urscheler | B05D 1/305 427/402 |
| 7,425,246 | B2 * | 9/2008 | Urscheler | D21H 19/82 162/137 |
| 8,304,004 | B2 * | 11/2012 | Sanders | B65D 77/20 426/113 |
| 9,434,491 | B2 * | 9/2016 | Sanders | B65D 1/34 |
| 9,434,500 | B2 * | 9/2016 | Sanders | B65D 81/386 |
| 2002/0136913 | A1 | 9/2002 | Schaedler et al. | |
| 2004/0121079 | A1 * | 6/2004 | Urscheler | B05D 1/305 427/420 |
| 2004/0191459 | A1 | 9/2004 | Driesten | |
| 2007/0054117 | A1 | 3/2007 | Katchko et al. | |
| 2007/0087212 | A1 | 4/2007 | Iyengar et al. | |
| 2011/0262745 | A1 | 10/2011 | Ronka | |
| 2013/0288030 | A1 * | 10/2013 | Yeu | B05D 7/52 428/213 |
| 2016/0153149 | A1 | 6/2016 | Mongrain | |
| 2018/0142418 | A1 * | 5/2018 | Sundholm | D21H 25/04 |
| 2018/0362792 | A1 * | 12/2018 | Brighenti | B32B 9/06 |
| 2019/0352854 | A1 * | 11/2019 | Backfolk | D21H 19/822 |
| 2020/0056333 | A1 * | 2/2020 | Backfolk | D21H 21/16 |
| 2020/0071883 | A1 * | 3/2020 | Backfolk | D21H 17/60 |
| 2020/0171796 | A1 * | 6/2020 | Backfolk | B65D 65/40 |

(Continued)

FOREIGN PATENT DOCUMENTS

| | | | |
|---|---|---|---|
| CN | 1759006 | A | 4/2006 |
| CN | 103442891 | A | 12/2013 |
| JP | 200236887 | A | 8/2003 |
| JP | 2006028697 | A | 2/2006 |
| RU | 2011119276 | A | 12/2012 |
| WO | 2009142739 | A1 | 11/2009 |
| WO | 2012163821 | A1 | 12/2012 |
| WO | 2013083504 | A1 | 6/2013 |
| WO | 2014005697 | A2 | 1/2014 |
| WO | 2015003275 | A1 | 1/2015 |
| WO | 2016016339 | A1 | 2/2016 |

(Continued)

OTHER PUBLICATIONS

International Searching Authority, Written Opinion of the International Searching Authority, PCT/IB2017/058047, dated Dec. 18, 2017.
International Searching Authority, International Search Report, PCT/IB2017/058047, dated Dec. 18, 2017.

(Continued)

*Primary Examiner* — Jose A Fortuna
(74) *Attorney, Agent, or Firm* — Greer, Burns & Crain, Ltd.

(57) ABSTRACT

The invention relates to a method of manufacturing a heat-sealable packaging material, the method comprising the steps of: providing a paperboard substrate comprising a top ply, applying a first dispersion barrier layer on the top ply, wherein the first dispersion barrier layer comprises a latex having a first glass transition temperature, and applying a second dispersion barrier layer on the first barrier layer, wherein the second dispersion barrier layer comprises a latex having a second glass transition temperature, wherein the second glass transition temperature is higher than the first glass transition temperature, wherein the grammage of the second dispersion barrier layer is lower than the grammage of the first dispersion barrier layer, and wherein the second dispersion barrier layer comprises pigments. The invention further relates to a respective heat-sealable packaging material.

13 Claims, 1 Drawing Sheet

(56) References Cited

U.S. PATENT DOCUMENTS

| | | | | |
|---|---|---|---|---|
| 2020/0173109 | A1* | 6/2020 | Saukkonen | B32B 23/06 |
| 2020/0283959 | A1* | 9/2020 | Flynn | D21H 19/82 |
| 2020/0332469 | A1* | 10/2020 | Nyflott | D21H 19/56 |

FOREIGN PATENT DOCUMENTS

| | | | | |
|---|---|---|---|---|
| WO | 2016170229 | A1 | 10/2016 | |
| WO | WO-2018116118 | A1 * | 6/2018 | D21H 21/52 |

OTHER PUBLICATIONS

"Acronal S 504—Adhesive Raw Materials," Technical data sheet, BASF SE, Ludwigshafen, Germany, www.basf.com/dispersions, 1 page.

Ovaska, S., "Oil and Grease Barrier Properties of Converted Dispersion-Coated Paperboards," Acta Universitatis Lappeenrantaensis 719, Diss. Lappeenranta University of Technology, Lapeenranta 2016, 92 pages.

Russian Search report for corresponding Russian application No. 2019122641/05(044260), dated Feb. 16, 2021.

Translation of Russian Office Action for corresponding Russian application No. 2019122641/05(044260).

* cited by examiner

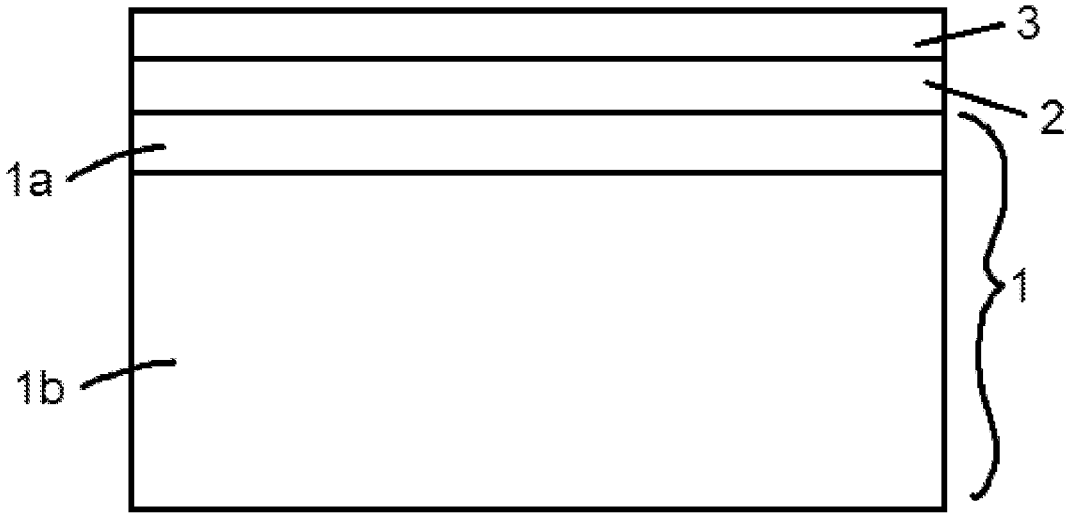
3
2
1a
1
1b

METHOD FOR MANUFACTURING A PACKAGING MATERIAL AND A PACKAGING MATERIAL MADE BY THE METHOD

This application is a U.S. National Phase under 35 U.S.C. § 371 of International Application No. PCT/IB2017/058047, filed Dec. 18, 2017, which claims priority under 35 U.S.C. §§ 119 and 365 to Swedish Application No. 1651732-8, filed Dec. 22, 2016.

BACKGROUND OF THE INVENTION

The present invention generally relates to coated paper or paperboard, and particularly to coated paper or paperboard having oil and grease resistance properties usable as packaging material.

Fiber based products, such as paper and paperboard, are widely used in food packaging. Fiber based products used as packages, such as liquid packages or food packages, must be able to withstand the influence of the packed items such as the influence of liquids or food on the fiber based product. One way is to provide the fiber based product with a barrier, for example a water or grease resistant barrier, which makes the fiber based product more resistant against liquids or grease. Barriers are usually applied by coating the fiber based substrate with compositions which provide the barrier properties. Different coatings can be applied depending on the needed properties of the barrier, while the number of coatings is usually limited by costs and the number of coating stations on a given machine. Commonly used materials when forming a barrier on a fiber based product are polyethylene (PE), polypropylene (PP), polyethylene therephthalate (PET), ethylene vinyl alcohol (EVOH) or ethylene vinyl acetate (EVA). The polymers can for example be laminated or extrusion coated on the fiber based product. Currently, most of the barrier coatings are manufactured with extrusion coating techniques and hence made off-line in a separate coating unit. However, off-line coating is expensive since it requires extra handling of the reels and an extra converting step. Another challenge is that extrusion coated films are more difficult to recycle and broke handling is practically impossible.

Dispersion barrier coating enables value chain integration with offline or online coating utilizing the existing coating equipment on paper or paperboard machine. Dispersion barrier coating is understood to mean a coating technique where latex, that is, an aqueous dispersion of fine polymer particles, is applied to the surface of a paper or paper board to form a solid, non-porous film after drying. Dispersion coatings can be recycled, which was one of the driving forces behind the development of the barrier dispersion coating technique. Common dispersion barriers use e.g. styrene-butadiene latex based formulations, polyvinyl alcohol, or polyethylene waxes. One problem related to dispersion coating formulations is the tendency of the coating to stick to hot guide or carrier rolls or stick to itself at the rewinder stage when the paperboard is rolled up. This phenomenon is called blocking. If blocking occurs, the product is damaged and cannot be used. The blocking is more obvious when the coating is fresh and hot. In addition, pressure, moisture and surface chemical properties of the contacted surface will also influence the blocking behavior. Blocking has been tried to be reduced by reducing production speed or by cooling the paperboard before the re-winder stage. However, these measures decrease the production efficiency significantly.

Various formulations or modified polymers have been disclosed addressing the problem with blocking while maintaining the barrier properties. US 2002136913 describes a packaging material with a polymer-based barrier coating wherein the polymer is a hydrogenated styrene-butadiene copolymer. The teaching relates to the effect of hydrogenated styrene-butadiene copolymer compared to non-hydrogenated copolymer. However, applying a second dispersion barrier is not mentioned. WO 2015/003275 A1 describes a foldable paper-based substrate coated with primer coat and top coat, wherein the top coating is blocking resistant. The top coat comprises a polymer or dispersion of a polymer or copolymer that provide barrier to the paper. The teaching however does not refer to the glass transition temperature of the polymers. WO 2012/163821 A1 discloses a packaging having a dispersion barrier comprising two different polymers having different glass transition temperatures. The said mixture provides barrier properties and improved blocking resistance. The teaching however only refers to the mixture of the different polymers, and the average glass transition temperature calculated from the different glass transition temperatures. WO 2009/142739 A1 describes a dispersion coating comprising a nanofiller, a crosslinking agent and a binder which provides barrier and blocking resistance. The teaching however does not refer to applying a second dispersion coating. JP 2006028697 A discloses a greaseproof paper with undercoat and overcoat layer formed by coating acrylic-type synthetic resin emulsion on a paper base material. The glass transition temperature of the undercoat layer resin is lower than the glass transition temperature of the overcoat layer resin. The greaseproof paper however is not intended for heat-sealing.

However, some prior art techniques might improve blocking resistance but at the expense of decreased production efficiency or poorer quality of the paperboard in view of grease resistance, mineral oil barrier properties, or sealability. Particularly sealing properties remain a crucial requirement for dispersion coated products. The coating further needs to be disintegratable and preferably also printable.

SUMMARY OF THE INVENTION

Thus, there remains a need for a dispersion coating method that eliminates or alleviates the problems with blocking. Particularly, it is an object of the present invention to provide a dispersion coated packaging material that provides blocking resistance, but also is heat-sealable and preserves barrier properties. The present invention also provides the barrier with good printability.

This object is met with the method and packaging materials according to the independent claims of the present invention. The dependent claims are related to preferred embodiments.

The invention provides a method of manufacturing a heat-sealable packaging material, the method comprising the steps of:

- providing a paperboard substrate comprising a top ply,
- applying a first dispersion barrier layer on the top ply, wherein the first dispersion barrier layer comprises a latex having a first glass transition temperature, and
- applying a second dispersion barrier layer on the first barrier layer, wherein the second dispersion barrier layer comprises a latex having a second glass transition temperature,
- wherein the second glass transition temperature is higher than the first glass transition temperature, wherein the grammage of the second dispersion barrier layer is lower than the grammage of the first dispersion barrier layer, and wherein the second dispersion barrier layer comprises pigments.

The packaging material made by the method according to the invention is heat-sealable and simultaneously has good barrier properties and blocking resistance. It is assumed that the first barrier layer comprising a latex with a lower glass transition temperature (Tg) provides good film forming and barrier properties and facilitates converting, while the second layer with higher Tg provides blocking resistance. It has surprisingly been found that a latex coated paperboard may provide high blocking resistance and yet remain heat-sealable, if the second layer is thinner than the first layer, which enable heat-sealability in spite of a higher glass transition temperature of the latex of the second or top layer. Without being bound to a specific theory, it is believed that the second dispersion barrier layer comprising pigments has the effect of ensuring that the barrier properties are not destroyed at the drying if the second layer is a bit more permeable and not due to quick film forming and consequently not destroyed by blister bubbles formed in the first layer at the drying. It is thus an important advantage that the barrier properties are preserved while also heat-sealability is provided. The advantages of the invention thus are achieved by observing several determinants for the first and second dispersion barrier layer, e.g. the differences in glass transition temperatures, grammage and the second dispersion barrier layer comprising pigments. Particularly, broke handling in the paper machine wet-end is facilitated. The major component of "white pitch" sometimes observed in paper machine systems is latex. Reducing pitch deposit problems in the wet-end of a paper machine can dramatically improve the efficiency of the machine.

DETAILED DESCRIPTION OF THE INVENTION

As used herein, "paper" and "paperboard" refers to a paper based substrate comprising fibers that can include, at least in part, vegetable, wood, and/or synthetic fibers. The paperboard substrate preferably comprises cellulosic fibres. A typical paperboard substrate used for packaging material comprises at least one ply, preferably several plies. The paperboard substrate is preferably a multilayer packaging paperboard, comprising at least two layers, a back ply and a top ply. The paperboard substrate may comprise for example a top and a back ply and at least one middle ply. The paperboard substrate may further comprise one or several middle plies. The paperboard substrate may have a basis weight of at least 150 gsm, preferably at least 200 gsm. Such a multilayer paperboard is particularly suitable for liquid and/or food packaging.

As used herein, "barrier layer" refers to a coating layer providing barrier properties to the paperboard substrate by reducing or eliminating the permeability of gases through the material and/or the absorption of liquids in the fiber structure. Barrier coatings are required to prevent the egress flavors, aromas or other ingredients of the packaged product, and especially to prevent the ingress into the package of oxygen, moisture, grease and oil, especially mineral oil, and other contaminants that might deteriorate the quality of the packaged product. The barriers particularly provide oil and/or grease barrier properties, which are particularly crucial for the packaging of food products. As used herein, "dispersion barrier layer" refers to a layer that has been brought by dispersion barrier coating onto the paperboard substrate.

As used herein, "latex" refers to an aqueous suspension of polymer particles, which can be natural polymers, synthetic polymers, or combinations thereof.

As used herein, "pigment" refers to extenders, fillers and coatings such as clay, chalk or kaolin used for papermaking as usually referred to in the paper industry.

The present invention will be further described in connection with various embodiments and other aspects. They may be combined freely unless the context clearly indicates otherwise.

The first, primary, barrier layer is applied onto the top ply of the paperboard substrate, while the second barrier layer provides the top layer. It is crucial for providing good barrier properties and blocking resistance that the glass transition temperature of the second, the top layer ($Tg_2$) is higher than the glass transition temperature of the first latex ($Tg_1$), as it has been found that if the second glass transition temperature is lower, the coating shows a higher number of pinholes and a stronger tendency of blocking that causes massive problems on the paper-making machine. Moreover, the barrier properties of the coated paperboard get lost. The second glass transition temperature ($Tg_2$) may be in a range from ≥10° C. to ≤40° C., preferably in a range from ≥20° C. to ≤25° C., higher than the first glass transition temperature ($Tg_1$).

In embodiments, the first glass transition temperature is in a range from ≥−10° C. to ≤15° C., preferably in a range from ≥−10° C. to ≤10° C. The glass transition temperature is determined by differential scanning calorimetry method [ASTM D7426-08 (2013)]. The glass transition temperature depends on the ratio of monomer or polymers units such as the ratio of copolymerized butadiene or acrylate units to the copolymerized styrene monomer units, degree of crosslinking, molecular weight distribution, additives, etc. In embodiments, the second glass transition temperature can be in a range from ≥10° C. to ≤40° C., preferably in a range from ≥15° C. to ≤30° C., more preferably in a range from ≥20° C. to ≤25° C. A coated paperboard can be provided which provides an efficient barrier against grease and oil, especially mineral oil, and high water resistance. The values of the first and second glass transition temperatures can vary, for example in the given ranges, as long as the first glass transition temperature is lower than the second glass transition temperature.

In embodiments, the first dispersion barrier layer is applied in an amount in a range from ≥4 g/m$^2$ to ≤25 g/m$^2$, preferably in an amount in a range from ≥5 g/m$^2$ to ≤15 g/m$^2$. The grammage of the second dispersion barrier layer is preferably lower than the grammage of the first layer. The grammage of a paper sheet or coating layer refers to the weight expressed as grams per square metre, gsm or g/m$^2$. As used herein, gsm and g/m$^2$ may be used interchangeable. In embodiments, the second dispersion barrier layer is applied in an amount in a range from ≥3 g/m$^2$ to ≤20 g/m$^2$, preferably in an amount in a range from ≥5 g/m$^2$ to ≤15 g/m$^2$, more preferably in a range from ≥5 g/m$^2$ to ≤12 g/m$^2$. The grammage of the layers may be nearly the same, as long as the first layer preferably has a higher grammage. The grammage of the second dispersion barrier layer may be in a range from ≥1 g/m$^2$ to ≤10 g/m$^2$, or in a range from ≥2 g/m$^2$ to ≤5 g/m$^2$, or in a range from ≥3 g/m$^2$ to ≤5 g/m$^2$, lower than the grammage of the first dispersion barrier layer. It has surprisingly been found that although a quite small amount of latex with higher Tg may be used as an outer, or second, barrier layer, heat-sealing of the coated paperboard is still possible.

The first and the second dispersion barrier layer may be applied by use of any known coating technology such as blade, curtain, film press, spray, rotogravure, reverse rotogravure, foam coater or the like. The minimum film formation temperature (MFFT) of the latex in both the first and the second dispersion barrier layer may be in a range from ≥0° C. to ≤20° C. A minimum film formation temperature in this range may provide for the forming of a smooth and continuous film.

In embodiments, the first dispersion barrier layer may comprise pigments in an amount in a range from ≥0 wt % to ≤40 wt %, preferably in an amount in a range from ≥5 wt % to ≤20 wt %, more preferably in an amount in a range from ≥10 wt % to ≤15 wt %, based on the dry solid content. The first dispersion coating may or may not comprise pigments. The first dispersion barrier layer preferably comprises pigments in small amounts. Pigments may be selected from the group comprising clay, calcium carbonate and/or talc. The pigment is preferably a high aspect ratio pigment. The pigment in the first dispersion layer assists in improving coating hold-out and water retention. This advantageously enables a more efficient barrier at a lower coat weight. The first barrier dispersion preferably has good coating holdout.

The second dispersion barrier layer may comprise a high amount of pigments. In embodiments, the second dispersion barrier comprises pigments in an amount in a range from ≥30 wt % to ≤70 wt %, preferably in an amount in a range from ≥30 wt % to ≤50 wt %, based on the total solid content. Pigments may e.g. be selected from the group comprising clay, calcium carbonate and/or talc. The pigment preferably has an impact factor higher than 5, more preferably higher than 10, and most preferably higher than 15.

In embodiments, the first dispersion barrier layer comprises latex in an amount in a range from ≥70 wt % to ≤100 wt %, based on the dry solid content of the layer. The first dispersion barrier layer is applied on the top ply. In embodiments, the second dispersion barrier layer, which is applied on top of the first layer, comprises latex in an amount in a range from ≥50 wt % to ≤90 wt %, preferably in an amount in a range from ≥60 wt % to ≤80 wt %, based on the dry solid content of the layer.

The latex for use in the first and/or second dispersion barrier layer may be selected from the group comprising styrene-butadiene latex, styrene-acrylate latex, acrylate latex, vinyl acetate latex, vinyl acetate-acrylate latex, styrene-butadiene-acrylonitrile latex, styrene-acrylate-acrylonitrile latex, styrene-butadiene-acrylate-acrylonitrile latex, styrene-maleic anhydride latex, styrene-acrylate-maleic anhydride latex, or mixture of these latexes. The latex is preferably a styrene-butadiene (SB) latex or a styrene-acrylate (SA) latex, acrylate latex, vinyl acetate latex, or vinyl acetat-acrylate latex, or mixture of these latexes. Preferably a mixture of latexes is used in both layers. The latex can be biobased, i.e. derived from biomass, such as biobased styrene-acrylate or styrene-butadiene latex. Biobased latex can provide similar performance, and provides improved carbon footprint. Both latexes of the first and second dispersion barrier layer may be the same, or different latexes can be used for the respective layers. However, even if, for example, a styrene-acrylate (SA) latex is used in both layers, the SA latex used in the second layer has a higher glass transition temperature than the SA latex used in the first layer, and preferably the SA latex used in the second layer also has a smaller average particle size.

In embodiments, the average particle size of the latex in the second dispersion barrier layer is smaller than the average particle size of the latex of the first dispersion barrier layer. The advantages is that smaller particles in the second layer give rise to a larger surface which leads to improved barrier properties and better film forming. In the first layer it is more advantageous to use larger average particle sizes so that the coating stays better on the surface. The term "average diameter" refers to the average value of all diameters or arithmetically averaged diameters, relative to all particles.

The first dispersion layer may further comprise co-binders such as starch, carboxymethyl cellulose (CMC), alkali-swellable thickeners, or polyvinyl alcohol (PVOH). Starch may be used in the first dispersion barrier layer in an amount in a range from ≥0 wt % to ≤50 wt %, or ≥10 wt % to ≤20 wt %, based on the dry solid content. The first barrier layer may contain cellulose nanofibers, preferably in a range from ≥1 wt % to ≤10 wt %, based on the dry solid content. Such co-binders may control the viscosity and water retention. Such co-binders may further provide grease barrier properties. The first barrier layer may further comprise thickening agents, preferably in a range from ≥0.5 wt % to ≤10 wt %, or ≥1 wt % to ≤5 wt %, based on the dry solid content. The coating might further contain other functional chemicals such as nanopigments, cross-linkers, lubricants, wet strength additives, and the like. The first dispersion barrier layer preferably has a KIT barrier in a range from ≥6 to ≤12, preferably in a range from ≥9 to ≤12. As used herein, the Kit Rating Number refers to a metric given to indicate how well a surface such as the surface of the dried coating of the coated paperboard resists penetration by a series of reagents of increasing aggressiveness [TAPPI method 559, 3M KIT test]. The first dispersion barrier layer preferably also has a mineral oil barrier determined as the hexane vapor transmission rate (HVTR) of ≤100. HVTR [BASF method] values below 100 provide for a good protection of the packaged food goods.

The second dispersion layer may further comprise one or more binders. The binder may have a glass transition temperature of ≥20° C., preferably in a range from ≥20° C. to ≤35° C. The second dispersion layer may additionally comprise one or several co-binders such as starch, carboxymethyl cellulose (CMC), alkali-swellable thickeners, or polyvinyl alcohol (PVOH). The co-binder may have a glass transition temperature above 40° C. Such a glass transition temperature of the binder advantageously will enhance the block resistancy of the second dispersion barrier coating. A block resistant coating may facilitate drying. Less drying energy advantageously will lead to lesser problems with taste and odor, and assisting in heat transfer can lead to a non-tacky coating.

The amount of non-disintegratable material in both, first and second, dispersion barrier layers is preferably less than 20 wt %, more preferably less than 10 wt %, as calculated on the total solids amount in the coatings. This provides for that the dispersion coating preferably is re-dispersable.

Before being coated with the first and second dispersion barriers, the paperboard substrate may be surface sized with e.g. starch. The paperboard substrate has preferably a minimum roughness determined according to the Parker Print-Surf (PPS) method of PPS≤15 μm, more preferably ≤10 μm before being treated in accordance with the invention. The paperboard substrate further preferably has a porosity determined according to the Bendtsen method of below 500.

The invention further relates to a heat-sealable packaging material made by the method of the invention as described above. The heat-sealable packaging material obtained by the method is usable for paper coating applications that require barrier properties such as, for example, a water barrier and/or a grease and oil barrier, particularly in food packaging. The method particularly provides a coated paperboard suitable for heat-sealing.

The invention further relates to a heat-sealable packaging material comprising:

a paperboard substrate comprising a top ply, a first dispersion barrier layer on the top ply, wherein the first dispersion barrier layer comprises a latex having a first glass transition temperature (Tg), and a second dispersion barrier layer on the first barrier layer, wherein the second dispersion barrier layer comprises a latex having a second glass transition temperature, wherein the second glass transition temperature is higher than the first glass transition temperature, wherein the grammage of the second dispersion barrier layer is lower than the grammage of the first dispersion barrier layer, and wherein the second dispersion barrier layer comprises pigments.

It has been found that the heat-sealable packaging material according to the invention provides an efficient barrier against grease and oil, especially mineral oil, and high water resistance. It is particularly advantageous that the packaging material is heat-sealable and/or suitable for sealing by use of ultrasound, and particularly preserves good heat sealing properties. The packaging material may be sealed by other methods than heat-sealing, heat-sealability however is a most important feature as heat-sealing is widely used in the food packaging fields. It is particularly advantageous that the dispersion coated paperboard provides for a heat-sealable package that particularly preserves good heat sealing properties.

The paperboard substrate comprises at least one ply, preferably several plies, for example a top and a back ply and at least one middle ply. The paperboard substrate is preferably a multilayer packaging paperboard, comprising at least two layers, a back ply and a top ply. The paperboard substrate may have a basis weight of at least 150 gsm, preferably at least 200 gsm. The paperboard substrate may further comprise one or several middle plies. Such a multilayer paperboard is particularly suitable for liquid and/or food packaging. The paperboard substrate may be surface sized with e.g. starch. The paperboard substrate has preferably a minimum roughness determined according to the Parker Print-Surf (PPS) method of ≤15 μm, more preferably ≤10 μm before being coated. The paperboard substrate further preferably has a porosity determined according to the Bendtsen method of below 500.

It has been found that the good barrier properties and blocking resistance advantageously provided by the packaging material is based on that the second glass transition temperature is higher than the first glass transition temperature. The second glass transition temperature may be in a range from ≥10° C. to ≤40° C., preferably in a range from ≥20° C. to ≤25° C., higher than the first glass transition temperature. The values of the first and second glass transition temperatures can vary, as long as the first glass transition temperature is lower than the second glass transition temperature. The first glass transition temperature can be in a range from ≥−10° C. to ≤15° C., preferably in a range from ≥−10° C. to ≤10° C. The second glass transition temperature can be in a range from ≥10° C. to ≤40° C., preferably in a range from ≥15° C. to ≤30° C., more preferably in a range from ≥20° C. to ≤25° C.

In embodiments, the first dispersion barrier layer can have a grammage or coat weight in a range from ≥4 g/m$^2$ to ≤25 g/m$^2$, preferably in a range from ≥5 g/m$^2$ to ≤15 g/m$^2$. The grammage of the second dispersion barrier layer is lower than the grammage of the first dispersion barrier layer. In embodiments, the second dispersion barrier layer can have a grammage or coat weight in a range from ≥3 g/m$^2$ to ≤20 g/m$^2$, preferably in a range from ≥5 g/m$^2$ to ≤15 g/m$^2$, more preferably in a range from ≥5 g/m$^2$ to ≤12 g/m$^2$. The grammage of the layers may be nearly the same, as long as the first layer preferably has a higher grammage. The grammage of the second dispersion barrier layer may be in a range from ≥1 g/m$^2$ to ≤10 g/m$^2$, or in a range from ≥2 g/m$^2$ to ≤5 g/m$^2$, or in a range from ≥3 g/m$^2$ to ≤5 g/m$^2$, lower than the grammage of the first dispersion barrier layer. It has surprisingly been found that although a quite small amount of latex with higher Tg may be used as an outer, or second, barrier layer, heat-sealing of the coated paperboard is still possible.

In embodiments, the first dispersion barrier layer may comprise pigments in an amount in a range from ≥0 wt % to ≤40 wt %, preferably in an amount in a range from ≥5 wt % to ≤20 wt %, more preferably in an amount in a range from ≥10 wt % to ≤15 wt %, based on the dry solid content. The first dispersion coating may comprise no pigments. The first dispersion barrier layer preferably comprises pigments in small amounts. Pigments may be selected from the group comprising clay, calcium carbonate and/or talc. The pigment is preferably a high aspect ratio pigment. The pigment in the first dispersion layer assists in improving coating hold-out and water retention. This advantageously enables a more efficient barrier at a lower coat weight. The first barrier dispersion preferably has good coating holdout.

The second dispersion barrier layer may comprise a high amount of pigments. In embodiments, the second dispersion barrier comprises pigments in an amount in a range from ≥30 wt % to ≤70 wt %, preferably in an amount in a range from ≥30 wt % to ≤50 wt %, based on the total solid content. Pigments may be selected from the group comprising clay, calcium carbonate and/or talc. The pigments preferably have an impact factor higher than 5, more preferably higher than 10, and most preferably higher than 15.

In embodiments, the latex in the first and/or second dispersion barrier layer may be selected from the group comprising styrene-butadiene latex, styrene-acrylate latex, acrylate latex, vinyl acetate latex, vinyl acetate-acrylate latex, styrene-butadiene-acrylonitrile latex, styrene-acrylate-acrylonitrile latex, styrene-butadiene-acrylate-acrylonitrile latex, styrene-maleic anhydride latex, styrene-acrylate-maleic anhydride latex, or mixture of these latexes. The latex is preferably a styrene-butadiene (SB) latex or a styrene-acrylate (SA) latex, acrylate latex, vinyl acetate latex, or vinyl acetat-acrylate latex, or mixture of these latexes. The latexes of the first and second dispersion barrier layer can be the same, or different latexes can be used for the respective layers. Preferably a mixture of latexes is used in both layers. The latex can be biobased, i.e. derived from biomass, such as biobased styrene-acrylate or styrene-butadiene latex. Biobased latex can provide similar performance, and provides improved carbon footprint. The minimum film formation temperature (MFFT) of the latex in both the first and the second dispersion barrier layer may be in a range from ≥0° C. to ≤20° C. A minimum film formation temperature in this range may provide for the forming of a smooth and continuous film. The latexes of the first and second dispersion barrier layer may be the same, or different latexes can be used for the respective layers. However, even if, for example, a styrene-acrylate (SA) latex is used for both layers, the SA latex of the second layer has a higher glass transition temperature than the SA latex of the first layer, and preferably the SA latex of the second layer also has a smaller average particle size. In embodiments, the average particle size of the latex in the second dispersion barrier layer is smaller than the average particle size of the latex of the first dispersion barrier layer. Smaller particles in the second layer advantageously give rise to a larger surface which leads to improved barrier properties and better film forming. Larger average particle sizes in the first layer advantageously improve that the coating stays better on the paperboard surface.

In embodiments, the first dispersion barrier layer comprises latex in an amount in a range from ≥70 wt % to ≤100 wt %, based on the dry solid content of the layer. In embodiments, the second dispersion barrier layer, which is applied on top of the first layer, comprises latex in an amount in a range from ≥50 wt % to ≤90 wt %, preferably in an amount in a range from ≥60 wt % to ≤80 wt %, based on the dry solid content of the layer.

The first dispersion layer may further comprise co-binders such as starch, carboxymethyl cellulose (CMC), alkali-swellable thickeners, or polyvinyl alcohol (PVOH). Starch may be used in the first dispersion barrier layer in an amount in a range from ≥0 wt % to ≤50 wt %, or ≥10 wt % to ≤20 wt %, based on the dry solid content. The first barrier layer may contain cellulose nanofibers, preferably in a range from ≥1 wt % to ≤10 wt %, based on the dry solid content. Such co-binders may control the viscosity and water retention. Such co-binders may further provide grease barrier properties. The first barrier layer may further comprise thickening agents, preferably in a range from ≥0.5 wt % to ≤10 wt %, or ≥1 wt % to ≤5 wt %, based on the dry solid content. The coating might further contain other functional chemicals such as nanopigments, cross-linkers, lubricants, wet strength additives, and the like.

In embodiments, the first dispersion barrier layer preferably has a KIT barrier in a range from ≥6 to ≤12, preferably in a range from ≥9 to ≤12. The first dispersion barrier layer preferably also has a mineral oil barrier determined as the hexane vapor transmission rate (HVTR) of <100. HVTR values below 100 provide for a good protection of the packaged food goods.

The second dispersion layer may further comprise one or more binders. The binder may have a glass transition temperature of ≥20° C., preferably in a range from ≥20° C. to ≤35° C. The second dispersion layer may additionally comprise one or several co-binders such as starch, carboxymethyl cellulose (CMC), alkali-swellable thickeners, or polyvinyl alcohol (PVOH). The co-binder may have a glass transition temperature above 40° C. Such a glass transition temperature of the binder advantageously will enhance the block resistancy of the second dispersion barrier coating.

The amount of non-disintegratable material in both, first and second, dispersion barrier layers is preferably less than 20 wt %, more preferably less than 10 wt %, as calculated on the total solids amount in the coatings. This provides for that the dispersion coating preferably is re-dispersable.

The invention further relates to a heat-sealed package or a package sealed by ultrasonic made from the heat-sealable packaging material made by the method according to the invention, or from the heat-sealable packaging material according to the invention. The package preferably is made by heat-sealing.

Further features of the present invention will become apparent from the examples and figures, wherein:

FIG. 1 is a schematic drawing of a packaging material according to an embodiment of the invention.

The packaging material shown in FIG. 1 comprises a paperboard substrate 1, comprising a top ply 1*a*. The paperboard substrate may be a multilayer packaging paperboard further comprising at least a back ply 1*b*. The top ply 1*a* of the paperboard is coated with a first dispersion barrier layer 2, wherein the first dispersion barrier layer 2 comprises a latex having a first glass transition temperature. A second dispersion barrier layer 3 is arranged on the first barrier layer 2, wherein the second dispersion barrier layer 3 comprises a latex having a second glass transition temperature. The glass transition temperature of the latex of the second dispersion barrier 3 is higher than the glass transition temperature of the latex of the first dispersion barrier layer 2. The grammage of the second dispersion barrier layer 3 is lower than the grammage of the first dispersion barrier layer 2. The second dispersion barrier layer 3 further comprises pigments. The dispersion barrier layers are brought by dispersion barrier coating onto the paperboard substrate. The material as shown in FIG. 1 is particularly suitable for heat-sealed product packages.

EXAMPLE 1

In order to evaluate the packaging materials of the invention, a test series was performed in which the blocking behaviour of packaging material manufactured in accordance with the invention was evaluated in a laboratory trial using a rod coater.

Coating compositions (primer, heat seal 1, heat seal 2) were prepared according to the table 1:

TABLE 1

| Raw material | Solids [%] | Dispersion 1 | Dispersion 2 | Dispersion 3 |
|---|---|---|---|---|
| CHP 204 (Tg 10) | 50 | 200 | | 100 |
| Acronal 728 (Tg 23) | 50 | | 200 | |
| Rheocarb 121 | 30 | 1 | 1 | |
| Hydragloss 90 | 72 | 100 | 100 | |
| NaOH | 10 | 2 | 2 | |
| Total | | 303 | 303 | |
| Theoretical dry content [%] | | 56.9 | 56.9 | 50 |

CHP 204 is a SA Latex having a glass transition temperature of 10° C., Acronal 728 is a SA latex available from BASF having a glass transition temperature of 23° C. Rheocarb 121 is an acrylic thickener, and Hydragloss 90 is a kaolin clay pigment.

The coating composition was coated by use of a rod coater on uncoated paperboard Cupforma Natura, 232 g/m$^2$, which is a three-layer paperboard with two outer layers made of bleached kraft pulps and a middle layer comprising bleached kraft pulp and CTMP (Chemi-Thermo-Mechanical Pulp).

The properties of the packaging material of two test runs is summarized in table 2:

TABLE 2

| run | layer 1, coating grammage [gsm] | layer 2, coating grammage [gsm] | layer 1 | layer 2 | Cobb600 [g/m$^2$] | Heat seal (hot bar) [° C.] |
|---|---|---|---|---|---|---|
| 1 | 10 | 5 | Dispersion 1 | Dispersion 2 | 58 | 90 |
| 2 | 7 | 5 | Dispersion 3 | Dispersion 2 | 5 | 90 |

All test runs showed no or very little blocking tendency. This is a significant improvement over the previous, prior art, technique when using one, single latex, with a glass transition temperature (Tg) of around 10 in the coating and where we have observed a lot of problems related to blocking, and sometimes even the paperboard layers were not able to be separated after reel-up. In addition, as can be seen in table 2, the Cobb values observed were low, especially when using only latex with low glass transition temperature (Tg) as the first dispersion layer as in test run no. 2. Heat sealing was also was observed to be surprisingly good. At 100 all fibre tear.

EXAMPLE 2

A second test series was performed in which the blocking behavior of packaging material manufactured in accordance with the invention was evaluated in a production trial using an offline coater (roll applicator and metering rod).

The coating compositions of dispersion layers 1 and 2 were prepared according to the table 3:

TABLE 3

| Raw material | Solids [%] | dispersion layer 1 | dispersion layer 2 |
|---|---|---|---|
| CHP 204 | 50 | 4500 | |
| Acronal 728 | 50 | 4500 | 6000 |
| Rheocarb 121 | 30 | 40 | 40 |
| Hydragloss 90 | 72 | | 3000 |
| NaOH | 10 | 20 | 20 |
| Total | | 9060 | 9060 |

In accordance with example 1, the latexes used were SA Latexes CHP 204 having a glass transition temperature of 10° C., and Acronal 728 having a glass transition temperature of 23° C. Also Rheocarb 121 being an acrylic thickener, and Hydragloss 90 being a kaolin clay pigment were used.

Three trials were run with rod application and an offline coater. The results are summarized in table 4:

TABLE 4

| Trial # | Baseboard | Base board grammage [gsm] | coating grammage dispersion layer 1 [gsm] | coating grammage dispersion layer 2 [gsm] | Cobb600 [g/m$^2$] | KIT # |
|---|---|---|---|---|---|---|
| 1 | Cupforma Natura | 182 | 7 | 5 | 8 | 12 |
| 2 | Cupforma Natura | 213 | 11 | 7 | 5 | 12 |
| 3 | Cupforma Special | 312 | 6 | 5 | 5 | 12 |

As can be seen in table 4 from COBB and KIT values, all three trials using first and second dispersion layer according to the invention provided paperboard with high moisture and grease barrier values. Moreover, no problem with blocking was observed and satisfying heat-sealability.

Again, this provides important advantages compared to prior art methods causing severe blocking when the condition that the glass transition temperatures of the latex of the second dispersion layer is higher than the glass transition temperature of the latex of the first dispersion layer were not observed.

The invention claimed is:

1. A method of manufacturing a heat-sealable packaging material, the method comprising the steps of:

providing a paperboard substrate comprising a top ply, applying a first dispersion barrier layer on the top ply, wherein the first dispersion barrier layer comprises a latex having a first glass transition temperature and wherein the first dispersion barrier layer comprises pigments in an amount in a range from ≥0 wt % to ≤40 wt %, based on the dry solid content of the first dispersion barrier layer, and applying a second dispersion barrier layer on the first barrier layer, wherein the second dispersion barrier layer comprises a latex having a second glass transition temperature and wherein the second dispersion barrier layer comprises pigments in an amount in a range from ≥30 wt % to ≤70 wt %, based on the total solid content of the second dispersion barrier layer, wherein the second glass transition temperature is higher than the first glass transition temperature, and wherein the second dispersion barrier layer has a grammage lower than the grammage of the first dispersion barrier layer.

2. The method according to claim 1, wherein the first glass transition temperature is in a range from ≥−10° C. to ≤15° C.

3. The method according to claim 1, wherein the second glass transition temperature is in a range from ≥10° C. to ≤40° C.

4. The method according to claim 1, wherein the first dispersion barrier layer is applied in an amount in a range from ≥4 g/m$^2$ to ≤25 g/m$^2$.

5. The method according to claim 1, wherein the second dispersion barrier layer is applied in an amount in a range from ≥3 g/m$^2$ to ≤20 g/m$^2$.

6. The method according to claim 1, wherein the second dispersion barrier layer comprises latex in an amount in a range from ≥50 wt % to ≤90 wt %, based on the dry solid content of the second dispersion barrier layer.

7. The method according to claim 1, wherein the average particle size of the latex in the second dispersion barrier layer is smaller than the average particle size of the latex of the first dispersion barrier layer.

8. The method according to claim 1, wherein the first glass transition temperature is in a range from ≥−10° C. to ≤10° C.

9. The method according to claim 1, wherein the second glass transition temperature is in a range from ≥15° C. to ≤30° C.

10. The method according to claim 1, wherein the first dispersion barrier layer is applied in an amount in a range from ≥5 g/m$^2$ to ≤15 g/m$^2$.

11. The method according to claim 1, wherein the second dispersion barrier layer is applied in an amount in a range from ≥5 g/m$^2$ to ≤15 g/m$^2$.

12. The method according to claim 1, wherein the first dispersion barrier layer comprises pigments in an amount in a range from ≥5 wt % to ≤20 wt %, based on the dry solid content of the first dispersion barrier layer.

13. The method according to claim 1, wherein the second dispersion barrier layer comprises latex in an amount in a range from ≥60 wt % to ≤80 wt %, based on the dry solid content of the second dispersion barrier layer.

* * * * *